US005950268A

United States Patent [19]

Murphy et al.

[11] Patent Number: 5,950,268

[45] Date of Patent: Sep. 14, 1999

[54] HAND-HELD SCRUBBING DEVICE

[75] Inventors: John S. Murphy, Brookpark; Richard C. Farone, Willoughby; Laurie Shumaker, Tallmadge; Robert A. Matousek, Lakewood; Craig Saunders, Rocky River; Jeffrey M. Kalman, Cleveland Heights; Michael F. Wright, Stow; David M. Brickner, Willoughy, all of Ohio

[73] Assignee: Royal Appliance Mfg. Co., Cleveland, Ohio

[21] Appl. No.: 08/982,325

[22] Filed: Dec. 2, 1997

[51] Int. Cl.[6] ..... A46B 13/02

[52] U.S. Cl. ..... 15/28; 15/97.1

[58] Field of Search ..... 15/22.1, 23, 24, 15/28, 29, 97.1

[56] References Cited

U.S. PATENT DOCUMENTS

| | | | |
|---|---|---|---|
| D. 223,945 | 6/1972 | Bousquet | 15/28 X |
| 773,436 | 10/1904 | Tangerman | 15/28 X |
| 1,557,551 | 10/1925 | Bertone | 15/23 |
| 1,578,013 | 3/1926 | Case | 15/29 |
| 1,667,579 | 4/1928 | Zweig | 15/97.1 |
| 1,682,216 | 8/1928 | Dellaree et al. | 15/28 X |
| 1,979,527 | 11/1934 | Bissell | 15/97.1 X |
| 3,026,552 | 3/1962 | Price | 15/28 X |
| 3,088,149 | 5/1963 | Potenza | 15/97.1 X |
| 3,235,897 | 2/1966 | Fortenberry | 15/24 |
| 3,968,789 | 7/1976 | Simoncini | 601/95 |
| 4,137,588 | 2/1979 | Sandt et al. | 15/22.1 |
| 4,250,587 | 2/1981 | Beck, Jr. | 15/28 |
| 4,399,578 | 8/1983 | Bordeaux | 15/24 X |
| 4,512,053 | 4/1985 | Horak et al. | 15/28 |
| 4,780,992 | 11/1988 | McKervey | 15/24 X |
| 4,788,738 | 12/1988 | Monson et al. | 15/320 |
| 4,945,790 | 8/1990 | Golden | 81/57.14 |
| 4,964,398 | 10/1990 | Jones | 601/101 |
| 5,123,139 | 6/1992 | Leppert et al. | 15/230.17 |
| 5,173,983 | 12/1992 | Le | 15/28 |
| 5,423,102 | 6/1995 | Madison | 15/22.2 |
| 5,495,632 | 3/1996 | Baker | 15/4 |

FOREIGN PATENT DOCUMENTS

| | | | |
|---|---|---|---|
| 1062212 | 7/1959 | Germany | 15/23 |
| 54-123252 | 9/1979 | Japan | 15/28 |

*Primary Examiner*—Mark Spisich

*Attorney, Agent, or Firm*—Fay, Sharpe, Beall, Fagan, Minnich & McKee, LLP

[57] ABSTRACT

A hand-held scrubbing device used for cleaning and/or scrubbing bathroom walls, tile, tubs, faucets, crevices, shower stalls, and other surfaces. The hand-held scrubbing device includes a head which is rotatable about a longitudinal axis of an elongated body portion of the device. The head can simultaneously swivel with respect to the longitudinal axis of the elongated body portion. Various cleaning implements, such as brushes and scrubbing pads, are attached to the head. The device also includes a handle which is rotatable with respect to the elongated body portion and is locked into a pistol position or a wand position. Preferably, the device can include a universal joint assembly which allows the head to rotate and swivel with respect to the elongated body portion. A splash guard can be attached to the head. A motor is housed within a hollow portion of the elongated body portion and is powered by battery.

24 Claims, 10 Drawing Sheets

HAND-HELD SCRUBBING DEVICE

BACKGROUND OF THE INVENTION

The present application relates generally to scrubbing devices. More particularly, it relates to an improved hand-held powered scrubbing device for cleaning and scrubbing bathroom areas and other locations.

The invention is particularly suited for use in cleaning and/or scrubbing bathroom floors, corners, bathroom tile, tubs, faucets, and crevices as well as scouring shower doors and walls. However, it should be appreciated that the device could also be used in many other applications, such as cleaning and scrubbing kitchen or laundry areas or other household or institutional locations, such as restaurants, nursing homes, hospitals, college dorms, hotels and the like.

Dampness of household surfaces is a well-known problem with areas adjacent to indoor plumbing. For example, shower stalls, bathtubs and adjacent tile and similar splash surfaces are particularly susceptible to the rapid growth of mold and mildew as well as build-ups of surface scum caused by soap residue, dirt and the like.

Over the years manually employed bristle brushes, used with bleach cleansers, were found to be the most expedient means for cleaning surfaces of the type enumerated. In recent times, attempts have been made to mechanize this type of cleaning project. However, the known devices were invariably heavy, bulky mechanisms which were difficult to work with and could be extremely dangerous when working around water or damp surfaces due to electrical shock. Also, many devices were not able to reach hard to clean areas, such as crevices behind faucets or toilets.

Numerous scrubbing devices have been developed for use in cleaning, scrubbing and for other applications. One known portable cleaning device is shown in U.S. Pat. No. 4,137,588. This device is a portable rechargeable battery operated hand-held cleaning device which is adapted to receive various cleaning implements, such as wire brushes and abrasive wheels. The device has dual internally housed transverse cleaning implement receiving tongues, each having a reciprocal motion limited to 180 degrees. A disadvantage of this device is that the cleaning implements are not able to rotate 360 degrees nor can they swivel with respect to a longitudinal axis of the device. Another disadvantage is that the device does not have a handle which can be rotated and locked into either a pistol position or a wand position, as may be desired.

Another known scrubbing device is disclosed in U.S. Pat. No. 4,250,587. This device has a hand-held scrubber which is attached to a wall-mounted motor through a drive cable. This device has the same shortcomings as the previously discussed device. Namely, the scrubber rotates but is not able to swivel. Also, there is no handle section which can be moved between a pistol position and a wand position. In addition, another disadvantage of this device is that the scrubber is connected to a wall mounted motor via a drive cable, thus limiting the range of use and travel of the scrubber.

Still another known brushing device, which is disclosed in U.S. Pat. No. 4,512,053, is a hand-held brushing device used to polish and buff shoes. This device has the same shortcomings as the devices discussed above. In addition, another disadvantage of this device is that it needs an electric cord, not batteries for supplying power to the motor. Also, this device does not allow the attachment of various cleaning implements.

U.S. Pat. No. 5,423,102 discloses a portable hand-held cleaning apparatus which is adapted to receive various cleaning implements, such as bristle brushes, chisels, wheels, etc. One disadvantage of this device is that its handle is not able to rotate interchangeably between a pistol position and a wand position. Another disadvantage of this device is that it does not have a splash guard or other means of protecting against water damaging the device.

Yet another hand-held scrubber is disclosed in U.S. Pat. No. 5,495,632. This hand-held scrubber has a pair of rotary hubs which rotate along the longitudinal axis. One disadvantage of this device is that the cleaning heads are not able to rotate about the longitudinal axis of the device or swivel about the longitudinal axis. Another disadvantage of this device is that it does not have a splash guard or other means of protecting against water damaging the device.

Accordingly, it has been considered desirable to develop a new and improved hand-held scrubbing device which would overcome the foregoing difficulties and others while providing better and more advantageous overall results.

BRIEF SUMMARY OF THE INVENTION

The present invention relates to a hand-held scrubbing device.

More specifically, the hand-held scrubbing device is used for cleaning and/or scrubbing bathroom floors, corners, tile, tubs, faucets, crevices, as well as scouring shower stalls. Various cleaning heads, such as bristle brushes and scrubber pads, can be attached to the scrubbing device for various cleaning and/or scrubbing operations.

The hand-held scrubbing device is comprised of an elongated body portion, a head attached to a first end of the elongated body portion, a cleaning implement selectively secured to the head, and a handle attached to a second end of the elongated body portion. The head is rotatable about the longitudinal axis of the elongated body portion. Also, the head is simultaneously adapted to swivel about the longitudinal axis of the elongated body portion.

The handle is selectively rotatable about the longitudinal axis of the elongated body portion. The handle is rotatable to a pistol position in which the handle is disposed at an acute angle with respect to the longitudinal axis of the elongated body portion. The handle is also rotatable to a wand position located along the longitudinal axis of the elongated body portion. The handle can be locked into position by a locking knob.

The head of the scrubbing device is comprised of a universal joint assembly which is used to allow attachment of various cleaning implements to the head. The universal joint assembly can also serve as a quick tool release for easy engagement and disengagement of various cleaning implements.

The scrubbing device is further comprised of a motor within the hollow portion of the elongated body portion. The motor is operably connected to the head for rotating the head. The scrubbing device also includes a splash guard, attached to the head, to protect the motor and the inside of the elongated body portion from water damage.

If desired, the scrubbing device can be further comprised of a head which includes a universal joint, a base for attaching the universal joint to the first end of the elongated body portion, an interface cover attached to the universal joint and a pad interface secured to the interface cover via fasteners. The universal joint includes a ball-shaped joint with tabs which protrude from the ball-shaped point. The interface cover includes slots and an inverse ball-shaped opening. The pad interface also includes an inverse ball-shaped opening. The tabs of the ball-shaped joint engage the slots of the interface cover to allow rotation of the head with respect to the longitudinal axis of the elongated body portion. The ball-shaped joint engages the inverse ball-shaped openings of the interface cover and the pad interface to hold the ball-shaped joint in place and to allow the head to swivel about the longitudinal axis of the elongated body portion.

A cleaning implement is attached to the pad interface. The pad interface and the cleaning implement can both have hook and loop (i.e., velcro) surfaces which interface and which enable quick attachment and release of the cleaning implement from the pad interface.

The scrubbing device can be further comprised of a motor with a longitudinal axis which is coaxial with the longitudinal axis of the elongated body portion. The motor includes an output shaft to which the head is attached.

The scrubbing device may also include a control element for varying the speed of rotation of the head. The control element is operably connected to the motor.

The handle can include an angled surface which engages a similarly angled surface of the elongated body portion. The handle can further include a stem with lips which engages a hole with ledges, located within the elongated body portion. The handle can be connected to the elongated body portion through the stem and hole arrangement.

Further, the scrubbing device can include batteries located within the elongated body portion, an on-off position switch, and a forward and reverse polarity switch for changing the direction of rotation.

One advantage of the present invention is the provision of a hand-held scrubbing device having a head which is able to both rotate and swivel about a longitudinal axis of an elongated body portion of the device.

Another advantage of the present invention is the provision of a hand-held scrubbing device having a handle which is rotatable about a longitudinal axis of an elongated body portion of the device to either a pistol position or a wand position and can be locked in either orientation.

Still another advantage of the present invention is the provision of a hand-held scrubbing device with a handle which has an angled surface which interfaces with an angled surface of the elongated body portion. The handle has a stem which engages a hole in the elongated body portion for facilitating rotation of the handle with respect to the elongated body portion.

Yet another advantage of the present invention is the provision of a hand-held scrubbing device with a universal joint assembly which includes a ball-shaped universal joint with tabs and an interface cover with slots. The tabs of the ball-shaped joint engage the slots of the interface cover to allow rotation of the head with respect to the longitudinal axis of the elongated body portion.

Still yet another advantage of the present invention is the provision of a hand-held scrubbing device with a ball-shaped universal joint and an interface cover and a pad interface, both of which have inverse ball-shaped openings, where the ball-shaped joint engages the inverse ball-shaped openings of the interface cover and the pad interface to hold the ball-shaped joint in place and allow the head to swivel with respect to the longitudinal axis of the elongated body portion.

A further advantage of the present invention is the provision of a hand-held scrubbing device with a pad interface and a cleaning implement which both have hook and loop (i.e., Velcro) surfaces which selectively engage to allow quick attachment and release of the cleaning implement from the pad interface.

A still further advantage of the present invention is the provision of a hand-held scrubbing device with a splash guard attached to the head to protect the motor and the inside of the elongated body portion from water damage.

A yet further advantage of the present invention is the provision of a hand-held scrubbing device with a motor located within the elongated body portion which is operably connected to the head for rotating the head.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
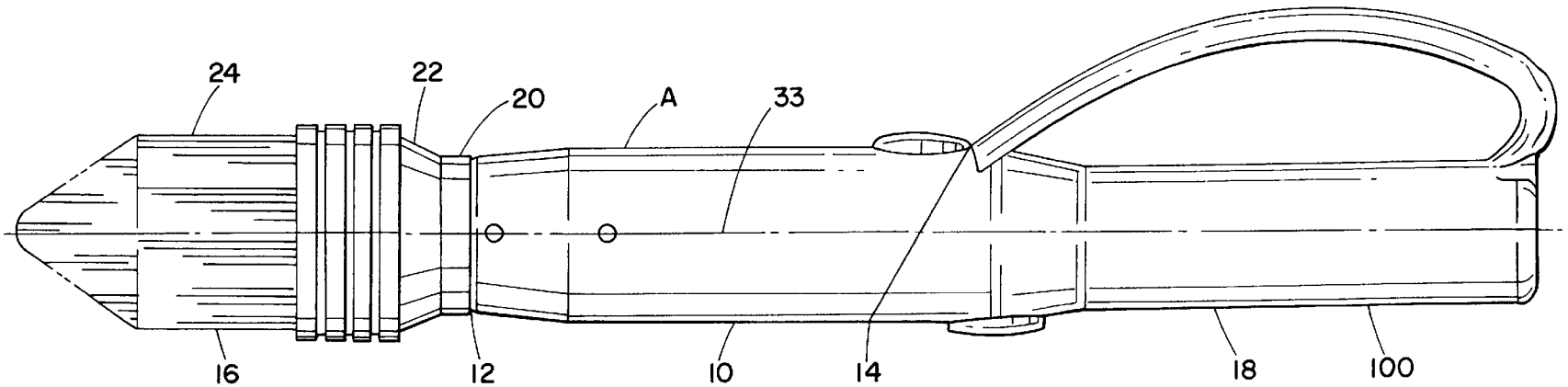
FIG. 1 is a side elevational view of a hand-held scrubbing device in accordance with a preferred embodiment of the present invention.

Referring now to the drawings, wherein the showings are for purposes of illustrating a preferred embodiment of this invention only and not for purposes of limiting same, FIG. 1 shows a hand-held battery powered scrubbing device A according to the present invention. The scrubbing device A can be used to scrub and or/clean bathroom walls, tile, tubs, faucets, crevices and shower stalls to remove mold, mildew, surface scum, soap residue, dirt, etc. The hand-held scrubbing device A can also be used in other cleaning applications, such as cleaning kitchens, laundry rooms and other household or institutional areas.

As shown in FIG. 1, the scrubbing device includes a elongated body portion 10, which has a first end 12 and a second end 14. A head 16 is attached to the first end 12 and a handle 18 is attached to the second end 14.

The head 16 includes a bushing 20 and a flexible sleeving 22, which are located adjacent the first end 12 of the elongated body. The flexible sleeving 22 acts as a splash guard to keep the inside of the elongated body portion 10 from getting wet and allows an for easy rinsing of the scrubbing device A in a sink while protecting the interior thereof.

Figure 2:
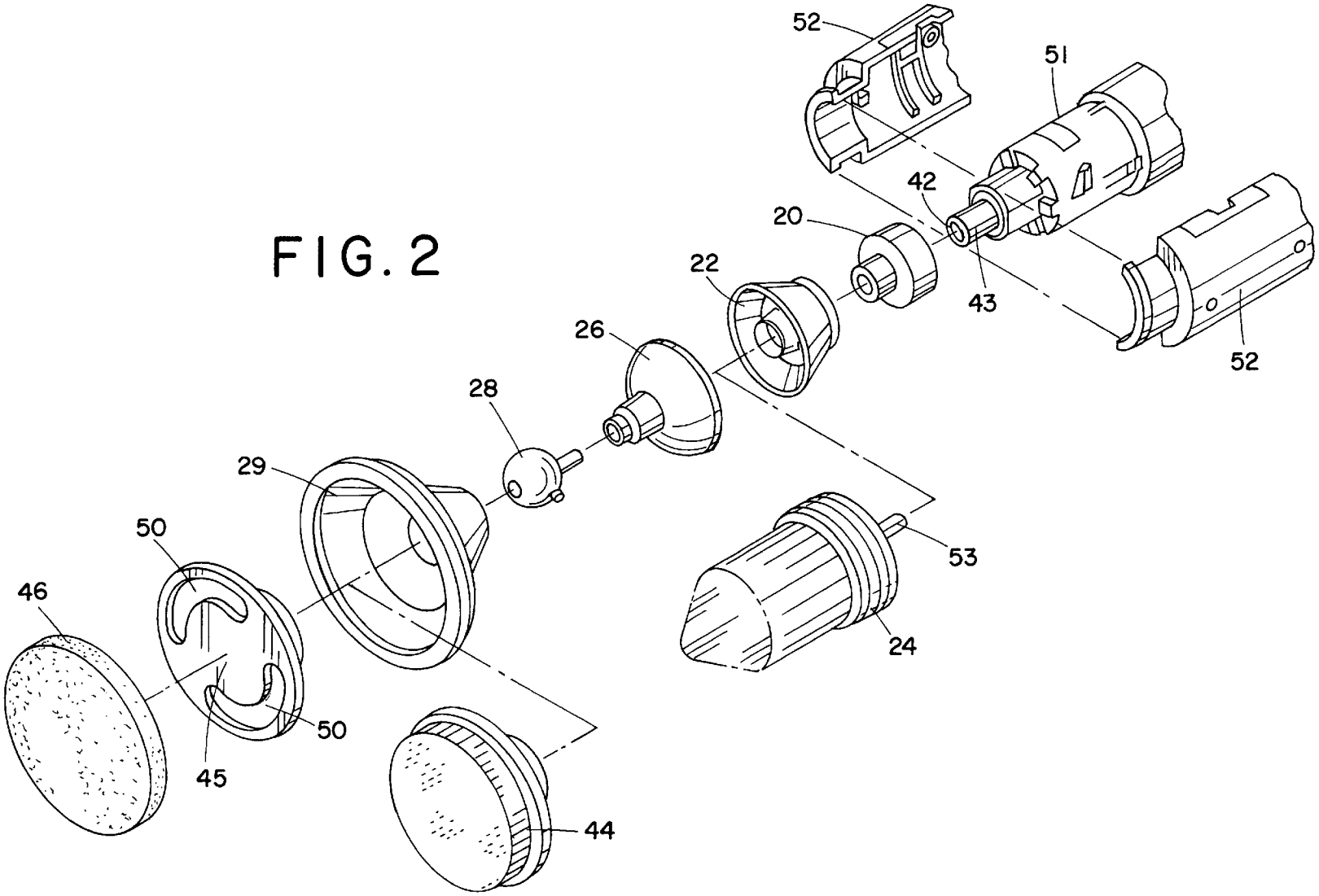
FIG. 2 is an exploded perspective view of a head of the scrubbing device of FIG. 1.

The cleaning implement can comprise a brush 24 or any of the other cleaning implement arrangements which are shown in FIG. 2. For example, another cleaning implement includes a base 26 (made of a known nylon material (P.A.) with a 30% glass finish), a universal joint 28 (made of acetal (P.O.M.)), and an interface cover 29 (made of a known nylon material(P.A.) with a 15% glass finish).

Figure 3A:
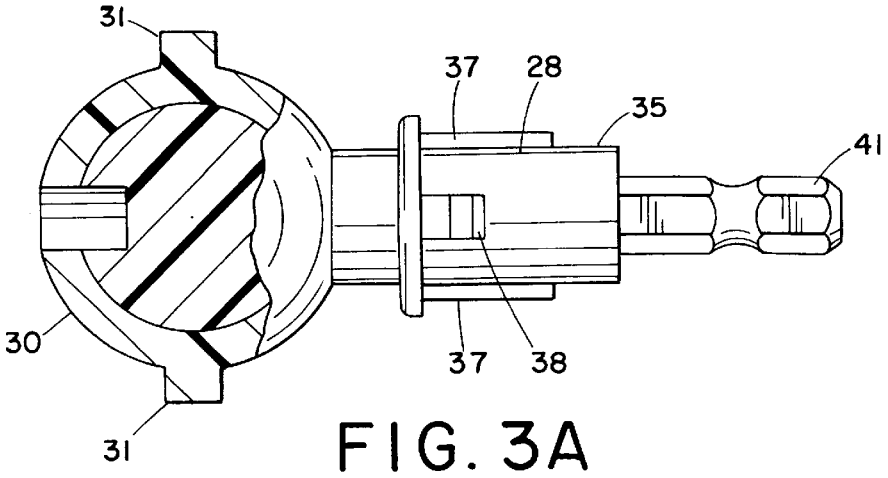
FIG. 3A is an enlarged side elevational view in partial cross section of a universal joint of the scrubbing device head of FIG. 2.
Figure 3B:
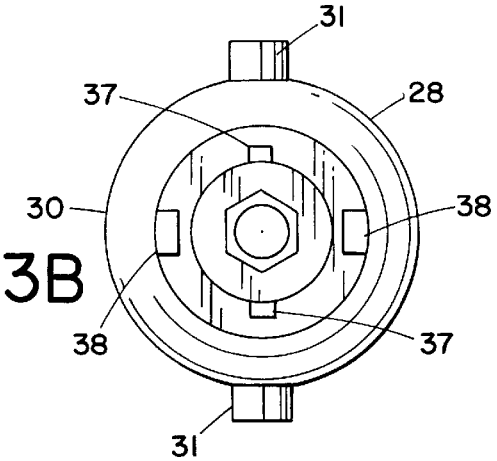
FIG. 3B is an end elevational view of the universal joint of the head of FIG. 3A.
Figure 4A:
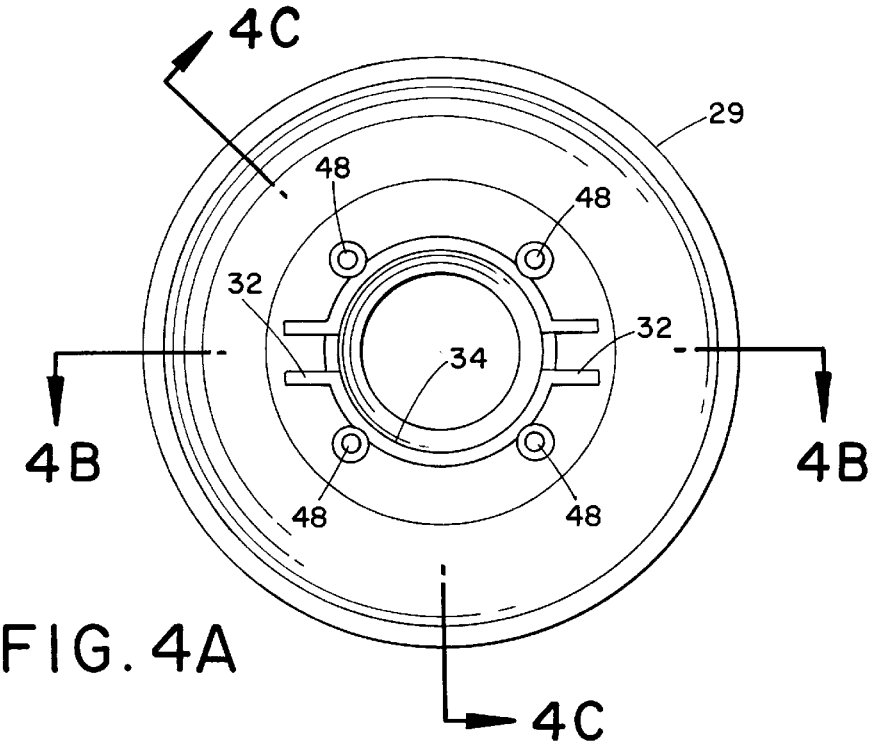
FIG. 4A is an enlarged front elevational view of an interface cover of the scrubbing device head of FIG. 2.

As shown in FIGS. 3A and 3B, the universal joint 28 consists of a ball-shaped joint 30 which has a pair of tabs 31 which protrude 180 degrees apart on opposite sides of the ball-shaped joint 30. The tabs 31 engage in slots 32 located 180 degrees apart on the inner surface of the interface cover 29, as shown in FIG. 4A. The tab 31 and slot 32 arrangement holds the interface cover 29 in place with respect to the universal joint 28. This arrangement allows a rotation of the ball-shaped joint 30 with respect to the longitudinal axis 33 of the elongated body portion 10 to be transmitted to the interface cover 29.

Figure 4B:
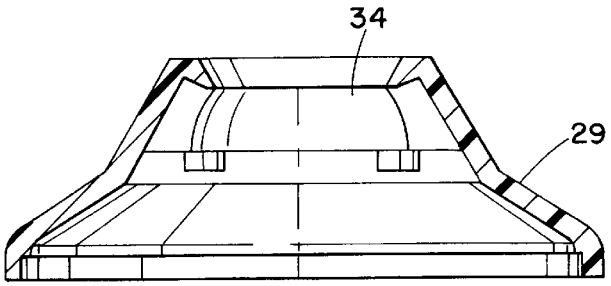
FIG. 4B is a side elevational view in cross section of the interface cover of FIG. 3A along line 4B—4B.
Figure 4C:
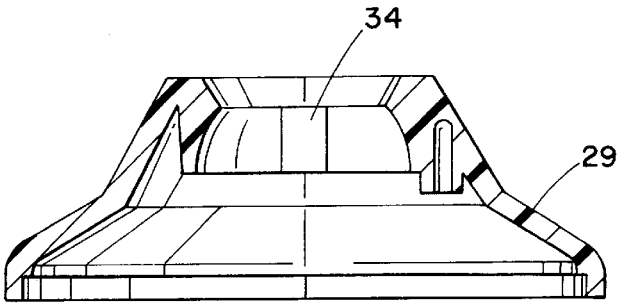
FIG. 4C is a side elevational view in cross section of the interface cover of FIG. 3A along line 4C—4C.

A lower end of the ball-shaped joint 30 functionally engages an inverse ball shaped opening 34 of the interface cover 29, as shown in FIGS. 4B and 4C. This arrangement allows the interface cover 29 to swivel with respect to the longitudinal axis 33 of the elongated body portion 10 along an axis extending through the pair of oppositely extending tabs 31.

Figure 3C:
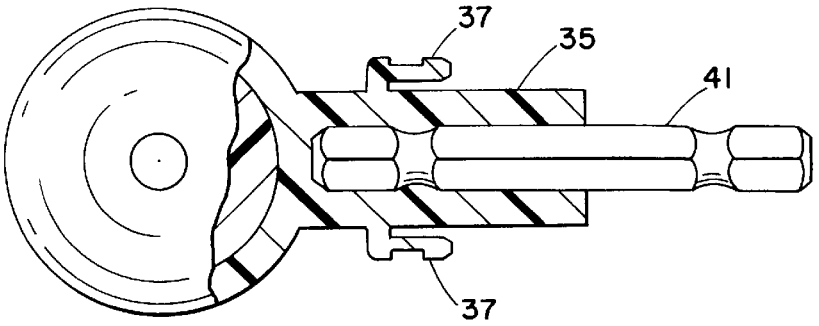
FIG. 3C is a side elevational view in partial cross section of the universal joint of the head of FIG. 3A.
Figure 5A:
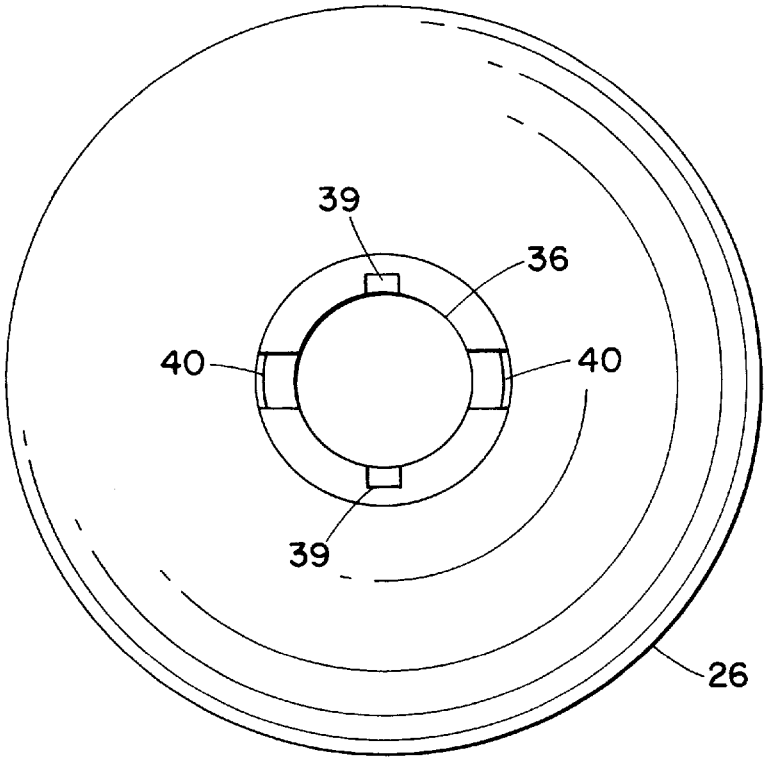
FIG. 5A is an enlarged front elevational view of a base of the scrubbing device head of FIG. 2.
Figure 5B:
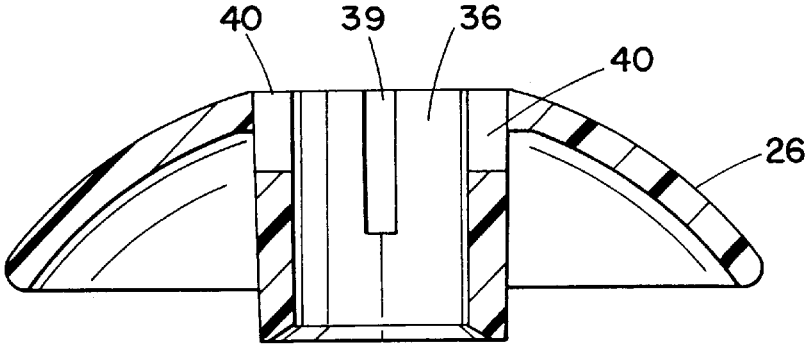
FIG. 5B is a side elevational view in cross section of the base of FIG. 5A.

The universal joint also includes a circular stem 35 shown in FIGS. 3A and 3C. The stem 35 engages a circular opening 36 in the base 26, which is shown in FIGS. 5A and 5B. The stem 35 includes a pair of spaced tabs 37, 38 shown in FIGS. 3A, 3B, and 3C which snap into and engage holes 39, 40, respectively (shown in FIGS. 5A and 5B), defined in the base 26, locking the base 26 to the universal joint 28. Therefore, the base 26 rotates along with the universal joint. On a distal end of the universal joint 28 there is provided a hex pin 41 which engages and snaps into an opening 42 of a gear box 43 (FIG. 2).

Other cleaning implements can further include a bristle brush 44 (made of acetal (P.O.M.) and nylon bristles) or a pad interface 45 (made of acetal (P.O.M.)) to which a scrubber pad 46 (made of nylon) can be secured. The pad interface 45 is held in place with respect to the interface cover 29 by four screws (not shown) which are threaded into the four holes 47 (shown in FIGS. 6A and 6C) of the pad interface 45 and the four holes 48 (shown in FIG. 4A) in the interface cover 29.

The pad interface 45 has an inverse ball shaped opening 49 (shown in FIG. 6B) which engages an upper end of the ball-shaped joint 30. The ball-shaped joint 30 is thus trapped between the interface cover 29 and the pad interface 45. However, the pad interface 45, and the interface cover 29, can swivel with respect to the ball-shaped joint 30 and the longitudinal axis 33 of the elongated body portion 10.

Figure 6A:
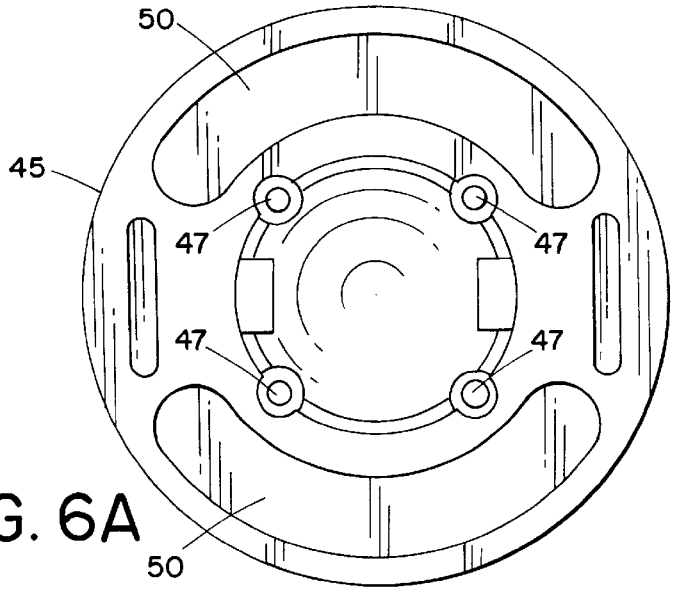
FIG. 6A is an enlarged front elevational view of a pad interface of the scrubbing device head of FIG. 2.
Figure 6B:
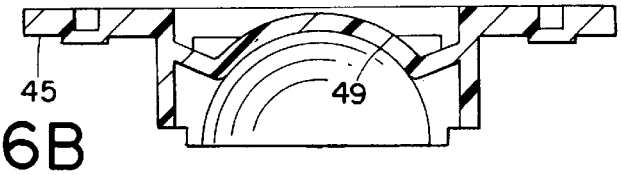
FIG. 6B is a side elevational view in cross section of the pad interface of FIG. 6A.
Figure 6C:
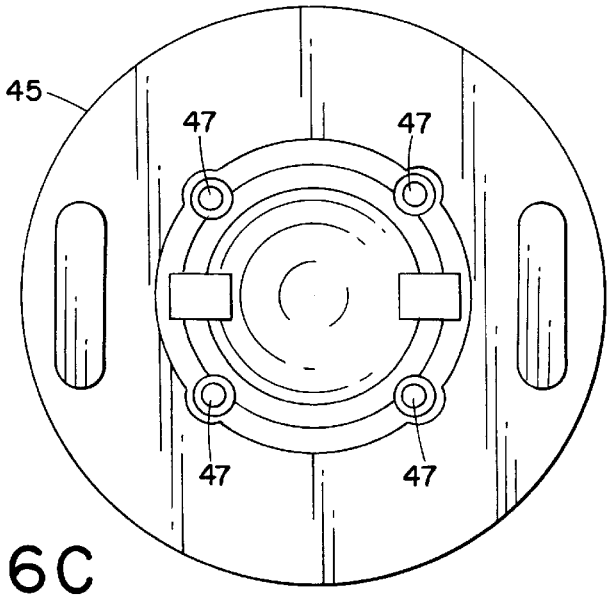
FIG. 6C is a rear elevational view of the pad interface of FIG. 6A.

A front surface of the pad interface 45 can include a pair of spaced hook and loop (Velcro) strips 50 as shown in FIG. 6A which allow attachment of the scrubber pad 46 or other cleaning implements which have cooperating hook and loop strips (not shown) on their bottom surfaces.

To provide power and allow the various cleaning implements to rotate, a motor 51 powers the gear box 43 which is connected to the cleaning implements. The motor 51 is housed within two housing halves 52 of the elongated body portion 10. The brush 24 includes a hex pin-shaped stem 53 which is inserted into the opening 42 in the gear box 43. The stem 53, and the hex pin 41 of the universal joint 28, serve as quick tool releases for easy installation and removal of the head 16 from the elongated body portion 10.

Figure 7A:
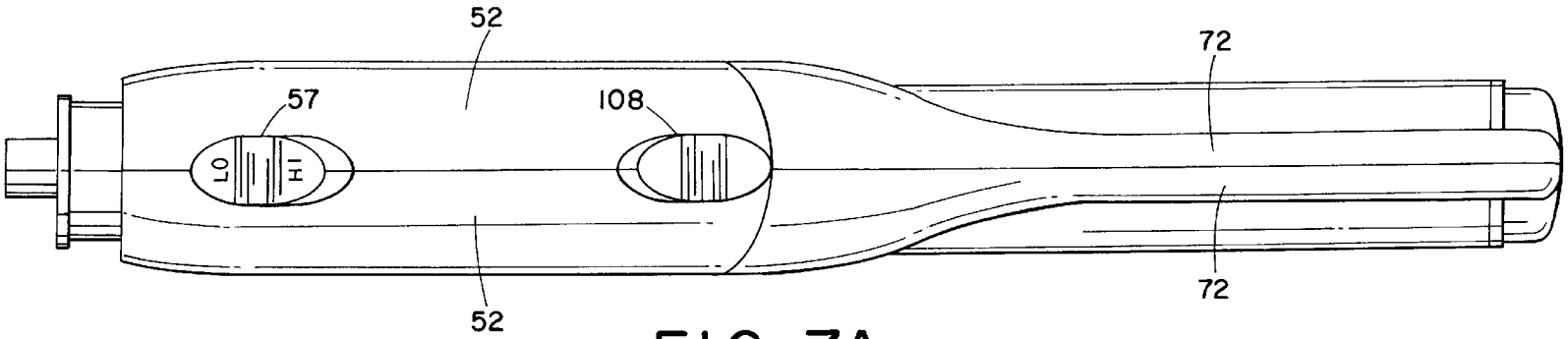
FIG. 7A is a top elevational view of the scrubbing device of FIG. 1.
Figure 7B:
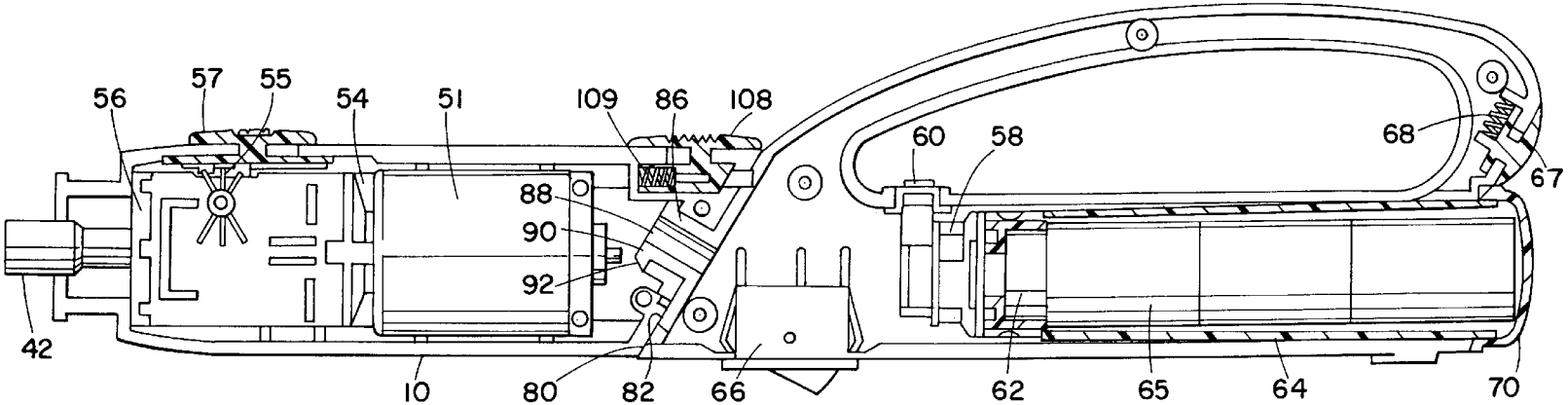
FIG. 7B is a side elevational view in cross section of the scrubbing device of FIG. 7A.

As shown in FIG. 7B, the motor assembly is housed within the elongated body portion 10. The motor 51 is mounted within the elongated body portion 10 by a motor mounting 54. The motor mounting 54 and a speed change switch 55 are held in place by a front retaining ring 56.

The speed of rotation of the head 16 can be increased or decreased by a speed change knob 57 connected to the speed change switch. As shown in FIG. 7A, the speed change knob 57 has two positions, "LO" and "HIGH", for decreasing and increasing, respectively, the speed of rotation of the head 16.

The direction of rotation can also be changed by a forward-reverse polarity switch 58 and a forward-reverse knob 60 mounted on the handle, as shown in FIG. 7B. The forward-reverse polarity switch 58 is connected to a terminal 62 of a power pack cabinet 64 holding batteries 65. Power is provided to the motor through an on-off switch 66 also mounted on the handle.

To install the batteries into the hollow portion of the handle 18, a push button 67 which is spring loaded via a spring 68, is depressed. A power pack cover 70 is then released from the end of the handle 18 and opens to expose the power pack cabinet 64. Batteries 65 are inserted and then the power pack cover 70 is pushed back into position and held in place by the push button 67.

Figure 7C:
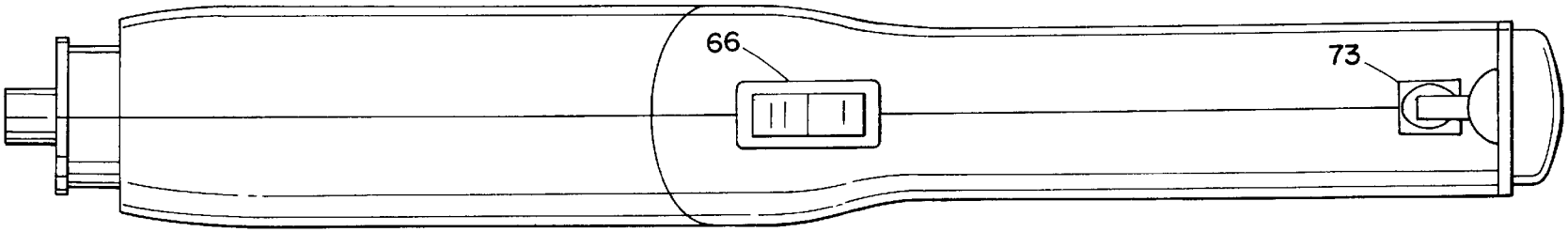
FIG. 7C is a bottom elevational view of the scrubbing device of FIG. 7A.

The handle 18 includes two handle cover halves 72, shown in FIG. 7A, held together by a U-clip 73 as shown in FIG. 7C. The handle 18 is rotatably mounted to the elongated body portion 10 through an angled interface. The angled interface includes an angled surface 80 of the elongated body portion 10 and an angled surface 82 of the handle 18. These two surfaces 80, 82 are flush with each other as shown in FIG. 7B. The handle 18 is secured to the elongated body portion 10 by a stem 86 of the handle which is inserted into a hole 88 on the angled surface 80 of the elongated body portion 10. The stem 86 has lips 90 which engage ledges 92 inside the hole 88.

Figure 8:
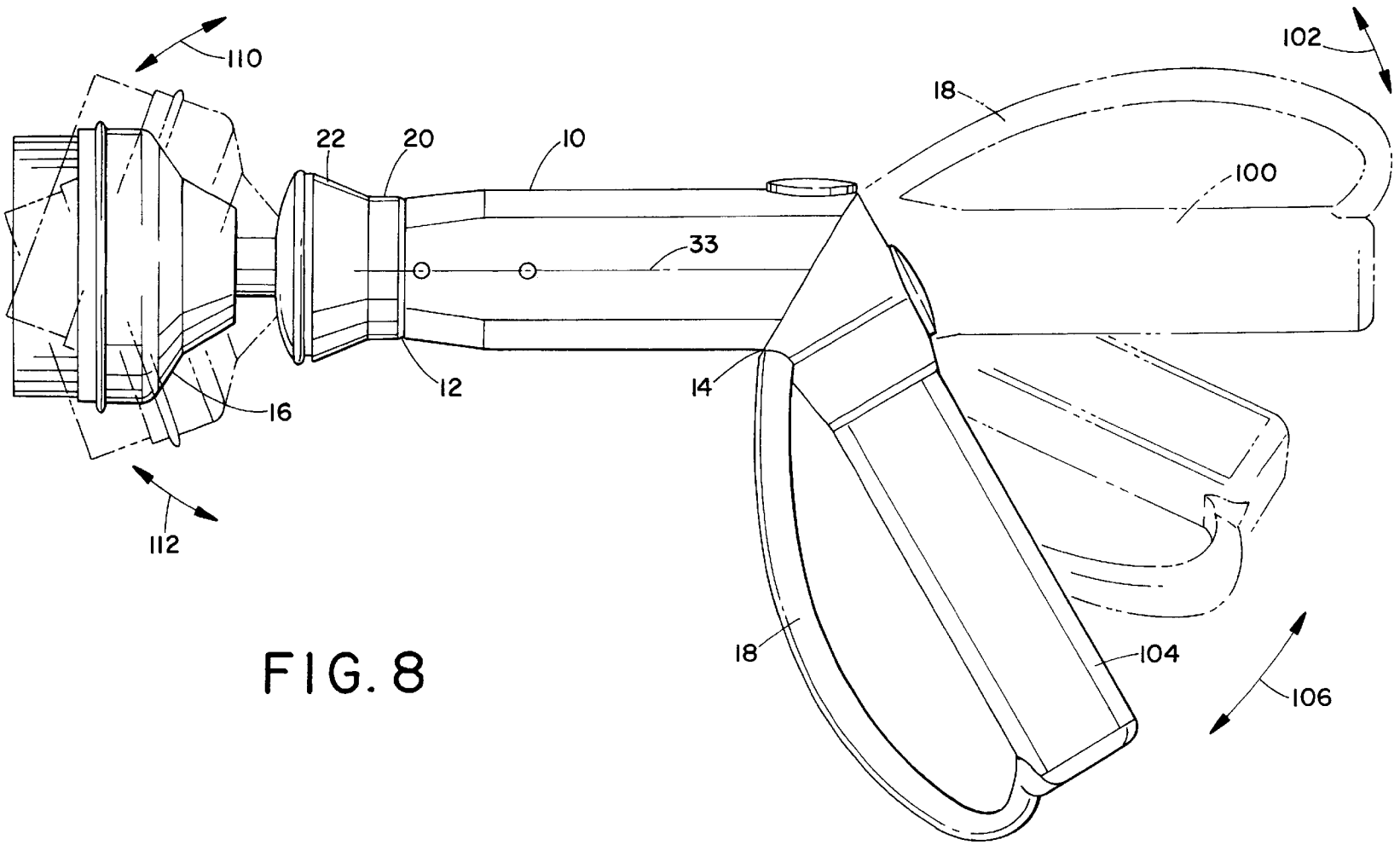
FIG. 8 is a side elevational view illustrating the rotation of the head and of the handle of the scrubbing device of FIG. 1.
Figure 9:
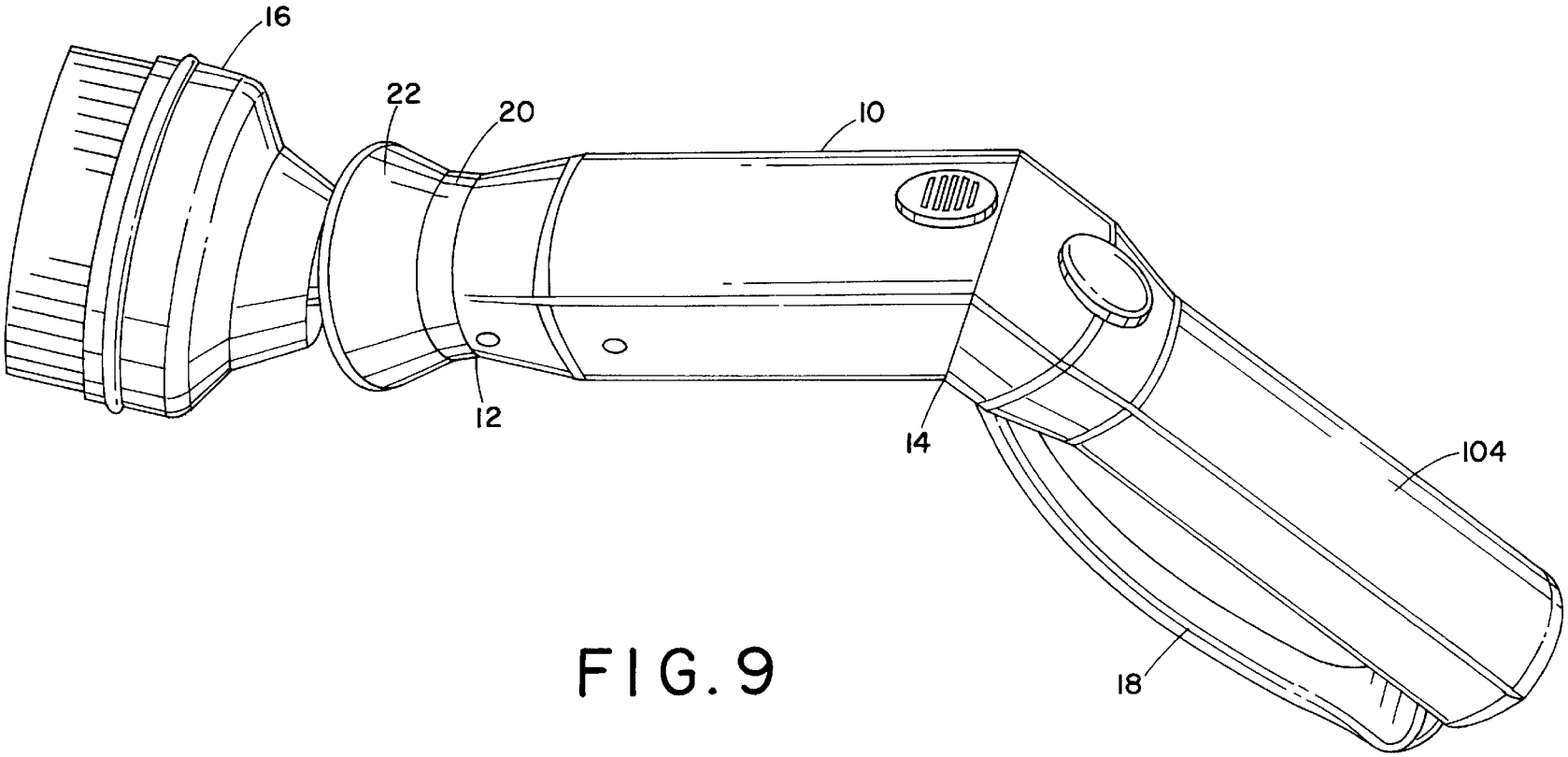
FIG. 9 is a perspective view of the scrubbing device of FIG. 1 in the pistol position.

The handle 18 is able to rotate with respect to the longitudinal axis 33 of the elongated body portion 10 through the angled interface provided by the angled surfaces 80, 82 and the stem 86 and hole 88 arrangement. As shown in FIG. 8, the handle 18 is able to rotate to a wand position 100 as shown by arrow 102 and is able to rotate to a pistol position 104 as shown by arrow 106. The wand position 100 is also shown in FIG. 1. The pistol position 104 is also shown in FIG. 9. The handle 18 is locked into the wand position 100 or the pistol position 104 by a locking knob 108 shown in FIGS. 7A and 7B. The locking knob 108 is held into position by a compression spring 109.

FIG. 8 further shows that the head 16 is able to swivel with respect to the longitudinal axis 33 of the elongated body portion 10 as shown by arrows 110, 112.

FIG. 9 shows the scrubbing device A in the pistol position 104 in a perspective view. The swiveling of the head 16 is also illustrated in FIG. 9.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A hand-held scrubbing device, comprising:

an elongated body portion having opposed first and second ends and a longitudinal axis;

a head attached to said first end, wherein said head is rotatable about the longitudinal axis of said elongated body portion and wherein said head is simultaneously adapted to swivel about said longitudinal axis of said elongated body portion;

a cleaning implement selectively secured to said head; and, a handle attached to said second end, said handle being selectively rotatable about said longitudinal axis of said elongated body portion.

2. The hand-held scrubbing device of claim 1 wherein said head comprises a universal joint assembly for allowing the attachment and quick release of various cleaning implements to said head.

3. The hand-held scrubbing device of claim 1 further comprising a splash guard attached to said head.

4. The hand-held scrubbing device of claim 1 wherein said handle is rotatable to a pistol position in which said handle is disposed at an acute angle with respect to the longitudinal axis of the elongated body portion.

5. The hand-held scrubbing device of claim 4 wherein said handle is rotatable to a wand position located along the longitudinal axis of the elongated body portion.

6. The hand-held scrubbing device of claim 5 wherein said handle is locked into a wand position or a pistol position by a locking knob attached to said elongated body portion.

7. The hand-held scrubbing device of claim 1 wherein said elongated body portion is hollow and further comprising a motor located in said elongated body portion, said motor being operatively connected to said head for rotating said head.

8. A hand held scrubbing device, comprising:

an elongated body portion having opposed first and second ends and a longitudinal axis;

a head attached to said first end, said head comprising:

a universal joint, an interface cover mounted on said universal joint, and a pad interface attached to said interface cover, said interface cover comprising slots and an inverse ball-shaped opening, wherein said universal joint includes a ball-shaped member having a pair of spaced tabs, said tabs engaging in said slots of said interface cover to allow rotation of the head around the longitudinal axis, and wherein said ball-shaped member functionally engages said inverse ball-shaped opening in said interface cover to allow said interface cover to swivel in relation to said longitudinal axis;

a splash guard attached to said head;

a cleaning implement selectively secured to said pad interface; and, a handle attached to said second end, said handle being selectively rotatable about said longitudinal axis of said elongated body portion.

9. The hand-held scrubbing device of claim 8 further comprising a base mounted between said interface cover and said first end of said elongated body portion.

10. The hand-held scrubbing device of claim 8 wherein said pad interface and said cleaning implement further comprise respective hook and loop surfaces, wherein said hook and loop surface of said pad interface matingly engages said hook and loop surface of said cleaning implement, selectively securing said cleaning implement to said pad interface and allowing quick installation and removal of said cleaning implement from said pad interface.

11. A hand-held scrubbing device comprising:

an elongated body portion having opposed first and second ends and a longitudinal axis;

a head attached to said first end, said head comprising:

a universal joint, an interface cover mounted on said universal joint, and a pad interface attached to said interface cover, said interface cover comprising slots and an inverse ball-shaped opening, wherein said universal joint includes a ball-shaped member having a pair of spaced tabs, said tabs engaging in said slots of said interface cover to allow rotation of the head around the longitudinal axis, and wherein said ball-shaped member functionally engages said inverse ball-shaped opening in said interface cover to allow said interface cover to swivel in relation to said longitudinal axis;

a cleaning implement selectively secured to said pad interface;

a handle attached to said second end; and, a base mounted between said interface cover and said first end of said elongated body portion, wherein said base comprises a pair of spaced slots for accommodating a pair of spaced tabs of said universal joint, said tabs securing said base to said universal joint.

12. A hand-held scrubbing device comprising:

an elongated body portion having opposed first and second ends and a longitudinal axis;

a head attached to said first end, said head comprising:

a universal joint, an interface cover mounted on said universal joint, and a pad interface attached to said interface cover, said interface cover comprising slots and an inverse ball-shaped opening, wherein said universal joint includes a ball-shaped member having a pair of spaced tabs, said tabs engaging in said slots of said interface cover to allow rotation of the head around the longitudinal axis, and wherein said ball-shaped member functionally engages said inverse ball-shaped opening in said interface cover to allow said interface cover to swivel in relation to said longitudinal axis;

a cleaning implement selectively secured to said pad interface; and, a handle attached to said second end, wherein said handle is rotatable to a pistol position in which said handle is disposed at an acute angle with respect to the longitudinal axis of the elongated body portion and said handle is rotatable to a wand position located along the longitudinal axis of the elongated body portion.

13. The hand-held scrubbing device of claim 12 wherein said handle is locked into the wand position and the pistol position by a locking knob attached to said elongated body portion.

14. A hand-held scrubbing device comprising:

an elongated body portion having opposed first and second ends and a longitudinal axis;

a head attached to said first end, said head comprising:

a universal joint comprising a hex pin which can extend into an aperture defined in said first end of said elongated body portion, an interface cover mounted on said universal joint, and a pad interface attached to said interface cover, said interface cover comprising slots and an inverse ball-shaped opening, wherein said universal joint includes a ball-shaped member having a pair of spaced tabs, said tabs engaging in said slots of said interface cover to allow rotation of the head around the longitudinal axis, and wherein said ball-shared member functionally engages said inverse ball-shaped opening in said interface cover to allow said interface cover to swivel in relation to said longitudinal axis;

a cleaning implement selectively secured to said pad interface; and, a handle attached to said second end.

15. The hand-held scrubbing device of claim 14 further comprising a motor located in said elongated body portion first end, wherein said hex pin extends into a gear box of said motor to operatively connect said head to said motor for rotating said head.

16. A hand-held scrubbing device, comprising:

an elongated body portion having opposed first and second ends, a hollow section and a longitudinal axis;

a head attached to said first end, wherein said head is rotatable about the longitudinal axis of said elongated body portion and wherein said head is simultaneously adapted to swivel about said longitudinal axis;

a motor located within said hollow section of said elongated body portion, said motor being configured to produce a rotary motion, said motor being operably connected to said head;

a control element for varying the speed of rotation of said head, said control element being operably connected to said motor;

a cleaning implement selectively secured to said head; and, a handle attached to said second end, said handle being selectively rotatable about said longitudinal axis.

17. The hand-held scrubbing device of claim 16 further comprising a splash guard attached to said head.

18. The hand-held scrubbing device of claim 16 wherein said head comprises:

a universal joint comprising a base and a ball-shaped member having a pair of spaced tabs; and, an interface cover mounted on said universal joint, said interface cover comprising slots and an inverse ball-shaped opening, wherein said tabs of said ball-shaped member engage in said slots in said interface cover to allow rotation of said head around said longitudinal axis, and wherein said ball-shaped member functionally engages said inverse ball-shaped opening in said interface cover to allow said interface cover to swivel in relation to said longitudinal axis.

19. The hand-held scrubbing device of claim 18 further comprising a pad interface secured to said interface cover via fasteners, wherein said pad interface is comprised of an inverse ball-shaped opening which engages said ball-shaped member of said universal joint, holding said pad interface and said interface cover to said ball-shaped member.

20. The hand-held scrubbing device of claim 19 wherein said cleaning implement and said pad interface are comprised of hook and loop surfaces, said hook and loop surface of said cleaning implement matingly engages said hook and loop surface of said pad interface, securing said cleaning implement to said pad interface and allowing quick installation and removal of said cleaning implement from said pad interface.

21. The hand-held scrubbing device of claim 18 further comprising a sleeve, wherein said sleeve is comprised of a surface which tapers toward the elongated body portion and is manually grippable by fingers, and wherein said sleeve is gripped to assist in disengaging said universal joint from said elongated body portion.

22. The hand-held scrubbing device of claim 16 wherein said handle is comprised of an angled surface which interfaces with a similarly angled surface of the elongated body portion, said handle includes a stem with lips which engage a ledge within a hole within the elongated body portion, said hole being located on the angled surface of said elongated body portion, said handle being connected to said elongated body portion through said stem and said hole, said handle being rotatable with respect to the elongated body portion along the angled surface of said handle and the angled surface of said elongated body portion from a wand position located along the longitudinal axis of the elongated body portion to a pistol position in which said handle is disposed at an acute angle with respect to the longitudinal axis of the elongated body portion.

23. The hand-held scrubbing device of claim 22 wherein the elongated body portion is further comprised of a locking knob for locking the handle in the pistol position or the wand position.

24. The hand-held scrubbing device of claim 16 wherein one of said elongated body portion and said handle further comprises:

batteries for powering said motor;

an on-off switch; and, a forward and reverse polarity switch.

* * * * *